US005096396A

United States Patent [19]

Welch

[11] Patent Number: 5,096,396

[45] Date of Patent: Mar. 17, 1992

[54] ROTARY APPARATUS HAVING PASSAGEWAYS TO CLEAN SEAL CHAMBERS

[75] Inventor: Elmer S. Welch, Silver Lake, Wis.

[73] Assignee: V. Q. Corporation, Silver Lake, Wis.

[21] Appl. No.: 664,814

[22] Filed: Mar. 5, 1991

[51] Int. Cl.[5] ..... F04C 2/18; F04C 15/00; F04D 29/08; F04D 29/70

[52] U.S. Cl. ..... 418/39; 418/144; 418/181; 418/206; 415/121.3; 415/174.3; 277/92; 277/95

[58] Field of Search ..... 418/39, 144, 181, 206; 415/174.2, 174.3, 110, 121.3; 277/91, 92, 95

[56] References Cited

U.S. PATENT DOCUMENTS

| | | | |
|---|---|---|---|
| 1,624,099 | 4/1927 | Haight | 418/39 |
| 2,013,499 | 9/1935 | Mechenstock | 277/95 |
| 2,633,807 | 4/1953 | Collura | 418/206 |
| 3,452,994 | 9/1969 | Gyory | 277/92 |
| 3,481,273 | 12/1969 | Werra . | |
| 4,153,400 | 5/1979 | Morita | 418/102 |
| 4,293,290 | 10/1981 | Swanson | 418/181 |
| 4,413,831 | 11/1983 | Washida et al. | 277/95 |
| 4,534,717 | 8/1985 | McCabe et al. | 418/181 |
| 4,538,959 | 9/1985 | Cantor et al. | 415/98 |

OTHER PUBLICATIONS

Undated page of technical literature, Albin Pump Type SLP.

Photocopy of Tri-Clover TM Catalog PR73, 1982.

Sheet of disclosure prepared by inventor, Elmer Scott Welch.

*Primary Examiner*—John J. Vrablik

*Attorney, Agent, or Firm*—Dressler, Goldsmith, Shore, Sutker & Milnamow, Ltd.

[57] ABSTRACT

Improvements are disclosed in a rotary, lobar, positive-displacement pump and in a rotary, centrifugal pump, whereby all product-contacting areas of the pumps can be effectively cleaned without disassembly, i.e., cleaned in place. Non-rotating seals seal the impellers and isolate the pump shafts from the product zone. Each seal has an elastomeric member molded integrally thereto. The seal is biased by the elastomeric member so as to be slidably pressed against an impeller. In the lobar pump, certain passageways can be selectively closed and opened, so as to adapt the pump for being used to pump a pumpable material when closed and for being cleaned by a cleaning solution flowing therethrough when opened. Valves may be alternatively provided for analogous purposes.

14 Claims, 5 Drawing Sheets 40
102
116
98
92
86
88
50
44
82
84
120
64
80
106
18
100
90
108
110
96
94
104
112
20
66
124
26
30
68
122
70
126
22
42
46
52
24

Fig. 6
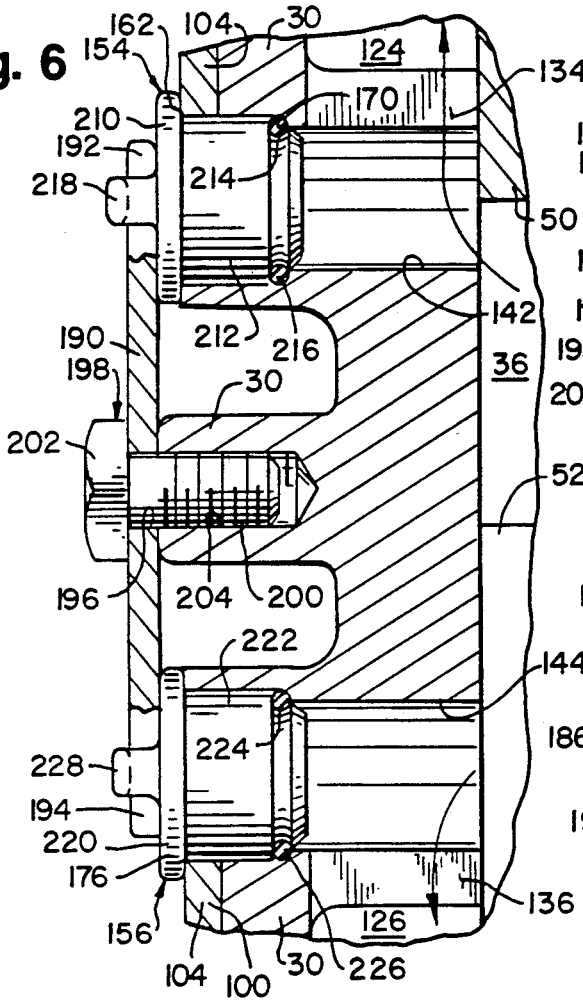
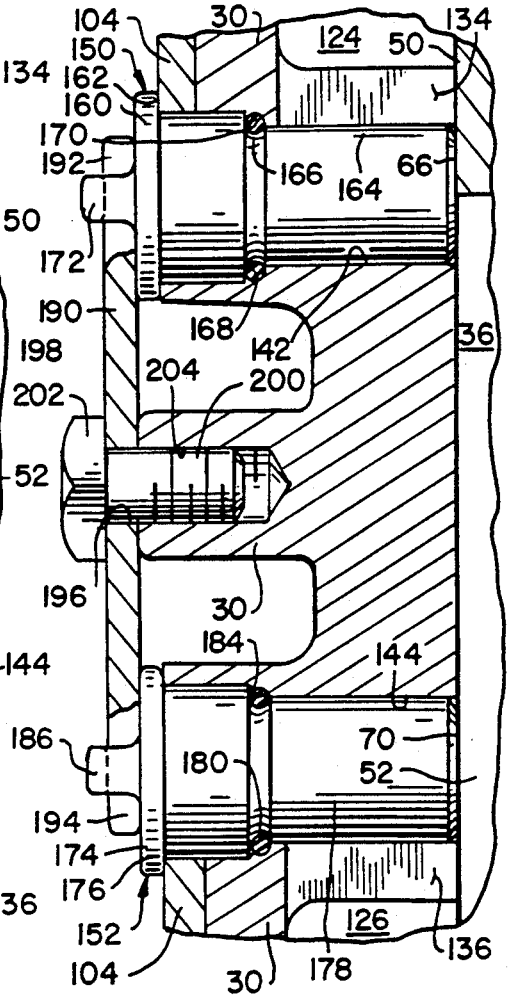
Fig. 7
Fig. 8
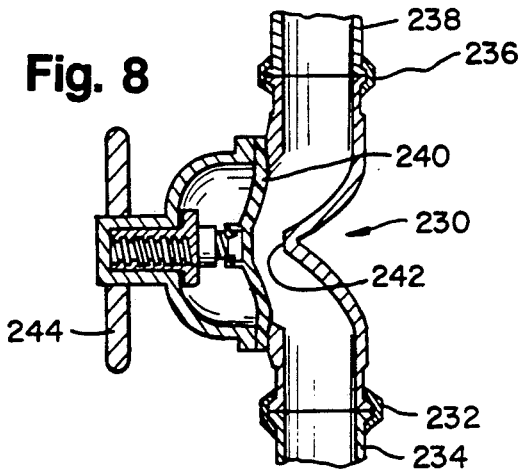

ROTARY APPARATUS HAVING PASSAGEWAYS TO CLEAN SEAL CHAMBERS

TECHNICAL FIELD OF THE INVENTION

This invention pertains to improvements in rotary apparatus, particularly but not exclusively rotary, lobar, positive-displacement pumps and rotary, centrifugal pumps, whereby the apparatus can be effectively cleaned without disassembly, i.e. cleaned in place. The improvements pertain particularly to an easy-to-clean seal, and to provisions for controlled flow during cleaning to surfaces not reachable in such apparatus, as known heretofore.

BACKGROUND OF THE INVENTION

Economics and improved cleaning make it desirable to clean food-processing equipment in place, without disassembly of the equipment, by circulating a cleaning solution through the equipment in a controlled manner. Often, plural cleaning solutions are used, in a controlled sequence. Although prior efforts have been made to clean rotary, centrifugal pumps without disassembly, those efforts have not been entirely satisfactory because those efforts have been characterized by low rates of cleaning solution flow. Frequently, extended cycles have been required for effective cleaning.

Conventionally, rotary pumps employ complex seals, in which the sealing face mating pressure is provided by a coiled spring. Typically, since such a seal must allow for slight movements to accommodate expansion, alignment, and wear, a movable seal, a movable shaft, or a movable member mounting the seal is required. Usually, in a food product pump, an O-ring also is required, which provides a seal between the spring-loaded seal and the pump shaft. The O-ring and associated recesses form a crevice that is difficult to clean, even under ideal conditions.

Positive-displacement pumps of current designs have seals, splined shafts, housings fitting tightly against lobar impellers, and, in some designs, nuts, all of which are in product zones with no provision for cleaning except through disassembly.

It would be highly desirable to provide improvements in rotary apparatus, particularly but not exclusively rotary, positive-displacement pumps and rotary, centrifugal pumps, whereby such apparatus could be effectively cleaned in place.

SUMMARY OF THE INVENTION

Broadly, this invention provides an improved, non-rotating seal, which makes it practical to isolate the splined driving shafts of a rotary, lobar, positive-displacement pump and to provide positive flow of a cleaning solution to the seal surfaces exposed to a pumped product, as well as to the axially facing and other surfaces of the lobar impellers of such a pump. Also, the improved, non-rotating seal may be advantageously used in other rotary apparatus, such as a rotary, centrifugal pump. Thus, this invention enables various rotary apparatus to be effectively cleaned without disassembly, i.e., cleaned in place.

Generally, this invention employs a rigid, non-rotating, annular seal, such as a carbon seal, and an elastomeric member, which may be integrally molded to the seal. The elastomeric member facilitates mounting the seal and biases a seal face of the seal against a seal face of a rotary structure in a rotary apparatus, such as an impeller of a rotary pump. This invention enables the seal to be hydraulically loaded and to be hydraulically balanced.

Broadly, this invention may be advantageously embodied in a rotary apparatus comprising a housing structure defining a product zone, which is exposed to fluid pressure when the rotary apparatus is operated, and rotary structure including a shaft, which extends at least partly through the housing structure. The rotary structure is rotatable about an axis defined by the shaft. The rotary structure defines a seal face. The apparatus comprises a structure for isolating at least a portion of the shaft from fluid pressure in the internal chamber. The isolating structure comprises a rigid, non-rotatable, annular seal, which is mounted to the housing structure, around the shaft, and which has a seal face pressed against the seal face of the rotary structure. The isolating structure comprises an elastomeric member, which has a portion fixed to the housing structure and a portion engaged with the seal and compressed so as to press the seal face of the seal against the seal face of the rotary structure.

In a preferred arrangement, the elastomeric member has a tubular portion and a flanged portion, which extends radially from the tubular portion. Moreover, the isolating structure comprises a seal retainer, which has a tubular body and an integral, radial flange. The tubular body extends at least partly through the seal so as to provide radial support for the seal. Furthermore, the housing structure has a mounting portion, to which the radial flange is secured in such manner that the flanged portion of the elastomeric member is retained between the seal retainer and the mounting portion, that the tubular portion of the elastomeric member engages an outer surface of the tubular body, along the tubular portion thereof and is supported by the tubular body against being deflected in a radially inward direction by fluid pressure in the product zone, and that the elastomeric member is compressed axially between the seal and the radial flange.

The outer surface of the tubular body of the seal retainer, namely its surface engaging the tubular portion of the elastomeric member, may be advantageously coated with a friction-reducing material, such as polytetrafluoroethylene (PTFE). Such material facilitates relative shifting movements between the tubular portion of the elastomeric member and the tubular body of the seal retainer, along the coated surface, upon axial movement of the rotary structure relative to the housing structure.

A rotary pump according to this invention may be generally described as comprising a housing structure defining a product zone, a shaft extending into the housing structure and defining an axis, about which the shaft is rotatable, and an impeller mounted on the shaft for conjoint rotation with the shaft. The impeller has a seal face. The rotary pump comprises a structure for isolating at least a portion of the shaft from the product zone. The isolating structure comprises an annular, rigid seal, which has a seal face, and an elastomeric member, which has a portion mounted fixedly to the housing structure and a portion compressed so as to press the seal face of the seal against the seal face of the impeller.

Preferably, the housing structure defines a product inlet, a product outlet, and an annular chamber surrounding the seal, the pump arranged to pump a pumpable product between the product inlet and the product outlet. Moreover, passageways are defined, which facilitate cleaning the pump. The passageways communicate with the annular chamber surrounding the seal. In a preferred arrangement, the impeller has an oppositely facing seal face, and the isolating structure comprises a similar seal with a seal face and an elastomeric member, which is mounted similarly to the housing structure, and which is compressed so as to press the seal face of the similar seal slidably against the oppositely facing seal face.

Advantageously, if the impellers are mounted to the respective shafts via splined connections, which are conventional in rotary, lobar, positive-displacement pumps, this invention removes the splined connections from the product zone. Because similar seals are used on opposite sides of the impellers, side-to-side hydraulic forces on the impellers are balanced so that the impellers can float on the splined shafts, whereby thermal contraction and expansion of the shafts do not cause side loading of the impellers. Thus, minimal side clearance is required, whereby sealing between the impellers and the housing structure is improved and pumping volume loss is minimized.

A rotary, lobar, positive-displacement pump according to this invention comprises a housing structure having a product inlet, a product outlet in opposed relation to the product inlet, an opposed pair of first apertures, and an opposed pair of second apertures. The housing structure defines a product zone.

Also, the positive-displacement pump comprises a first shaft defining an axis and extending through the product zone via the first apertures and a second shaft defining an axis and extending through the product zone via the second apertures. The respective shafts, which are parallel to each other, are arranged to be simultaneously but oppositely rotatable about their respective axes.

Moreover, the positive-displacement pump comprises a first impeller mounted on the first shaft for conjoint rotation with the first shaft and a second impeller mounted on the second shaft for conjoint rotation with the second shaft. Each of the first and second impellers has plural lobes (e.g., two, three, or four lobes) and has a front seal face and a back seal face. The lobes of the first impeller and the lobes of the second impeller interengage in the product zone for pumping a pumpable product from the product inlet, through the product zone, into the product outlet.

Furthermore, the positive-displacement pump comprises four similar, annular seals and four elastomeric members. Each seal has a seal face and is disposed around and in radially spaced relation to one of the shafts. Each elastomeric member biases a respective one of the seals so as to press its seal face slidably against a respective one of the seal faces of the impellers. The seal faces of the respective seals are pressed respectively against the front seal face of the first impeller, against the front seal face of the second impeller, against the back seal face of the first impeller, and against the back seal face of the second impeller. The four seals isolate the respective shafts from any product being pumped by the pump.

In a preferred arrangement, the housing structure and the impellers define an annular chamber surrounding each seal and surrounding a portion of the elastomeric member biasing such seal. Also, the housing structure defines an inlet-side passageway communicating with the product inlet via a portion of the product zone near the product inlet and with the annular chamber surrounding each seal and an outlet-side passageway communicating with the annular chamber surrounding each seal and with the product outlet via a portion of the product zone near the product outlet.

Moreover, in the preferred arrangement, the pump has devices for closing the respective inlet-side passageways so as to adapt the pump for being used to pump a pumpable product and for opening the respective inlet-side passageways so as to adapt the pump for being cleaned without disassembly. When the inlet-side passageways thus are opened, the pump can be effectively cleaned without disassembly by operating the pump while a cleaning solution is caused to flow through the passageways communicating with the annular chambers surrounding the seals. The pump may be used to cause the cleaning solution to flow therethrough from the outlet side to the inlet side. Another pump may be used to cause the cleaning solution to flow therethrough from the inlet side to the outlet side.

So as to accommodate the devices noted above, the housing structure may define a socket for each seal. The socket communicates with the product inlet and with the inlet-side passageway communicating with the annular chamber surrounding such seal. Accordingly, the devices noted above may comprise, for each socket, a main plug and an auxiliary plug. The main plug is adapted to be tightly fitted into such socket so as to close such socket and the inlet-side passageway with which such socket communicates. The auxiliary plug is adapted to be tightly fitted into such socket so as to close such socket but not the inlet-side passageway with which such socket communicates. The main plugs adapt the pump for pumping a pumpable material. The auxiliary plugs adapt the pump for being cleaned without disassembly.

Alternatively, the pump may comprise a valve associated with each seal. The valve controls fluid flow between the product inlet and the annular chamber surrounding such seal.

Preferably, the seals noted above constitute the only rotary seals between the housing structure and the respective impellers. It is preferred that each such seal is hydraulically balanced to maintain uniform seal face pressure under various product pressures.

A rotary, centrifugal pump according to this invention comprises a housing structure having a product inlet and a product outlet and defining an product zone. The housing structure defines an axis. The product inlet opens into the product zone at the axis. The product outlet is spaced radially from the axis.

Also, the centrifugal pump comprises a shaft defining an axis, which is coincident with the axis defined by the housing structure. The shaft has an end extending axially into the product zone. The shaft is arranged to be rotatably driven.

Moreover, the pump comprises an impeller, which is mounted to the shaft for conjoint rotation of the impeller with the shaft. The impeller comprises a sleeve portion and a flange portion. The sleeve portion surrounds the shaft end extending axially into the product zone. The flange portion has a front surface facing the product zone and a back surface defining a seal face. The impeller comprises generally radial vanes extending from the front face.

Furthermore, the centrifugal pump comprises an annular seal, which is supported by the housing structure, and an elastomeric member, which is mounted to the housing structure. The seal is disposed around and in radially spaced relation to the shaft. As biased by the elastomeric member, the seal is pressed slidably against the seal face so as to isolate the sleeve portion of the impeller from the product zone.

In the centrifugal pump, it is preferred that the housing structure has a surface close to a surface defined by the back face of the flange portion of the impeller, and that generally radial grooves are defined between these surfaces, preferably by the housing structure and the flange portion of the impeller at both of these surfaces. The grooves facilitate liquid flow from the product zone to a region between the seal and the housing structure.

Preferably, in the centrifugal pump, the seal noted above constitutes the only rotary seal between the housing structure and the impeller. It is preferred that such seal is hydraulically loaded. It is preferred, moreover, that such seal is hydraulically balanced.

These and other objects, features, and advantages of this invention are evident from the following description of two different embodiments of the invention with reference to the accompanying drawings.

BRIEF DESCRIPTION OF THE DRAWINGS

FIG. 1, is a fragmentary sectional view taken along line 3—3 of FIG. 1, in a direction indicated by arrows.

FIGS. 1 and 3, is a fragmentary, sectional view taken along line 4—4 of FIG. 1, in a direction indicated by arrows.

FIGS. 1, 3, and 4, is a fragmentary, sectional view taken along line 5—5 of FIG. 1, in a direction indicated by arrow.

FIG. 6, on a larger scale, is a fragmentary, sectional view taken along line 6—6 of FIG. 3, in a direction indicated by arrows. FIG. 6 shows a pair of auxiliary plugs, which adapt the pump for being cleaned.

FIG. 7 on a similar scale, is a fragmentary, sectional view similar to FIG. 6, except that FIG. 7 omits the pair of auxiliary plugs and shows a pair of main plugs, which adapt the pump for pumping a pumpable product.

FIG. 8 is a simplified, cross-sectional view of a diaphragm valve useful as an alternative to such main and auxiliary plugs.

DETAILED DESCRIPTION OF ILLUSTRATED EMBODIMENTS

Figure 1:
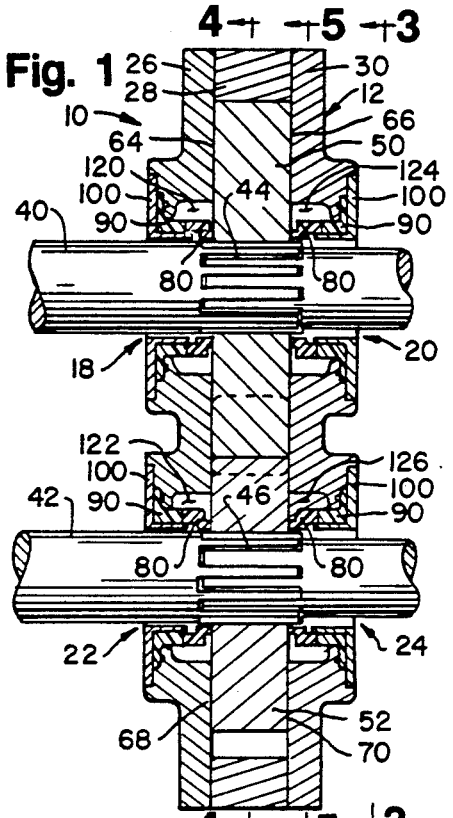
FIG. 1 is a fragmentary view taken in cross-section to show certain components of a rotary, lobar, positive-displacement pump constituting a preferred embodiment of this invention.

As shown in FIGS. 1 through 7, a rotary, lobar, positive-displacement pump 10 constitutes a preferred embodiment of the first aspect of this invention. The pump 10 is similar in many respects to rotary, lobar, positive-displacement pumps known heretofore but embodies improvements enabling the pump 10 to be effectively cleaned without disassembly, i.e., cleaned in place.

The pump 10 comprises a housing structure 12 having a product inlet 14, a product outlet 16 in opposed relation to the product inlet 14, an opposed pair of first apertures, namely a first front aperture 18 and a first back aperture 20, and an opposed pair of second apertures, namely a second front aperture 22 and a second back aperture 24. The product inlet 14 defines a low-pressure side of the pump 10. The product outlet 16 defines a high-pressure side of the pump 10. As used herein, "front" and "back" are arbitrary terms, which are used to differentiate between the apertures 18, 20, the apertures 22, 24, and other paired features of the pump 10.

The housing structure 12 is assembled in a known manner from a front section 26, a middle section 28, and a back section 30, along with a tubular element 32 (FIG. 4) defining the product inlet 14 and a tubular element 34 (FIG. 4) defining the product outlet, and along with certain retaining members described below. The housing structure 12 defines a product zone 36, which is closed except for the product inlet 14, the product outlet 16, and the apertures 18, 20, 22, 24.

Figure 3:
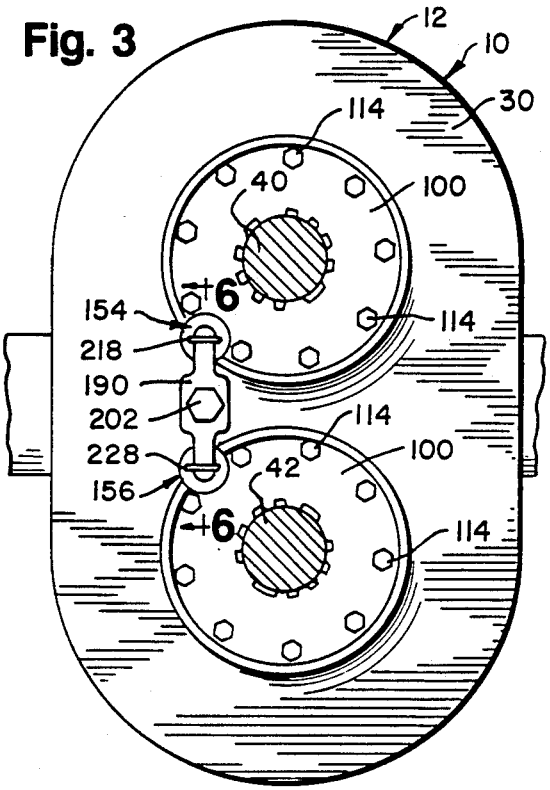
FIG. 3, on the sheet comprising
Figure 4:
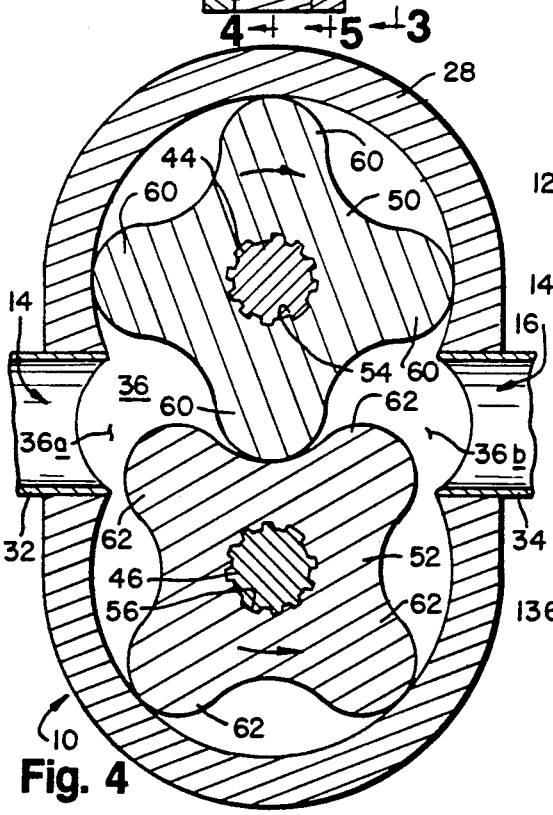
FIG. 4, on the sheet comprising
Figure 5:
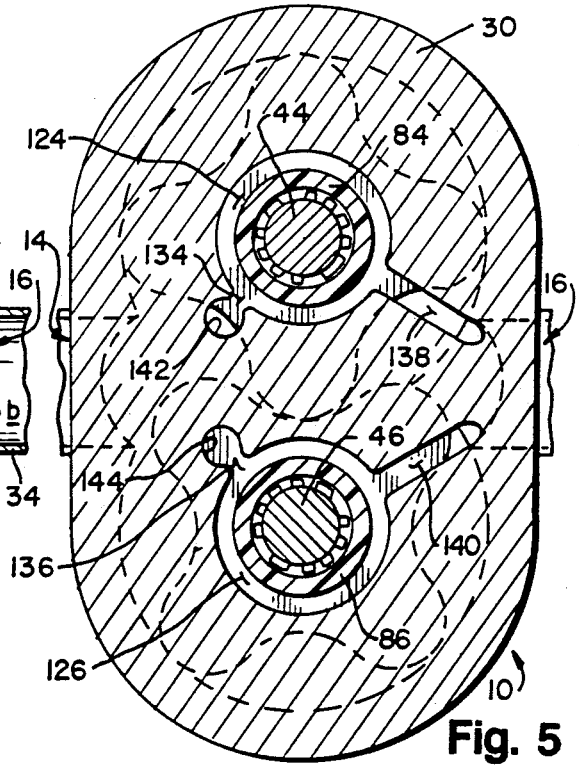
FIG. 5, on the sheet comprising
Figure 2:
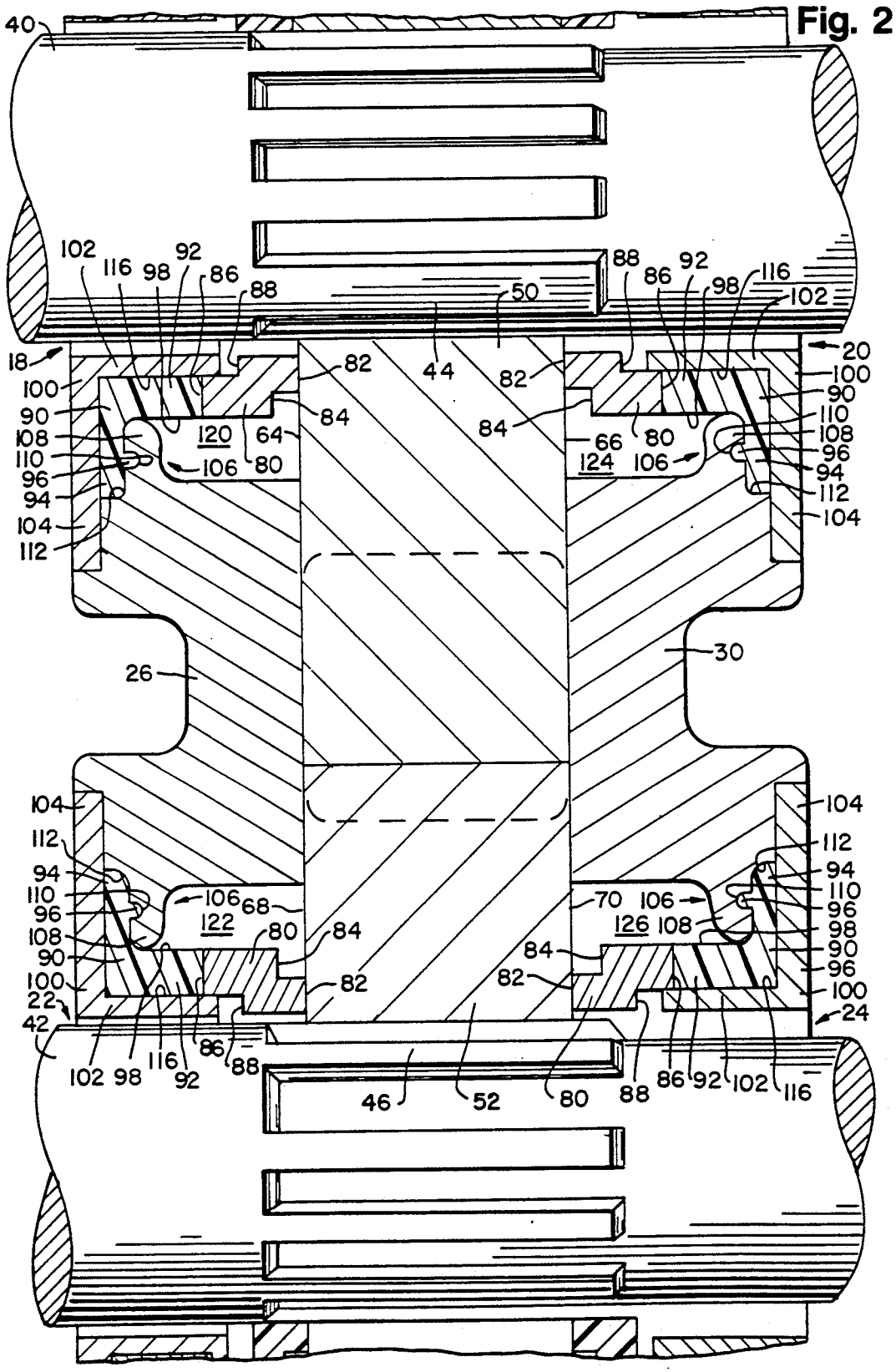
FIG. 2, on a different sheet, is a greatly enlarged, fragmentary detail of certain components shown in FIG. 1.

Also, the pump 10 comprises a first shaft 40 and a second shaft 42, each defining an axis. The first shaft 40, which has a splined portion 44, extends through the product zone 36 via the apertures 18, 20, in such manner that the splined portion 44 is centered between the front section 26 and the back section 30. The second shaft 42, which has a splined portion 46, extends through the product zone 36 via the apertures 22, 24, in such manner that the splined portion 46 is centered between the front section 26 and the back section 30. The respective shafts 40, 42, are journalled in bearings (not shown) in a known manner with the respective shafts 40, 42, parallel to each other. The first shaft 4 is arranged to be rotatably driven via a motor (not shown) in a known manner. The respective shafts 40, 42, are coupled to gearing (not shown) in a known manner, whereby the respective shafts 40, 42, are arranged to be simultaneously but oppositely rotatable about their respective axes. Thus, as shown in FIGS. 3, 4, and 5, the first shaft 40 is rotatable in a clockwise sense and the second shaft 42 is rotatable in a counterclockwise sense.

Moreover, the pump 10 has a first impeller 50 and a second impeller 52, each having four lobes. The first impeller 50 is disposed between the front section 26 and the back section 30 and is mounted on the first shaft 40 for conjoint rotation with the first shaft 40. The first impeller 50 has a central, splined aperture 54, which receives and coacts with the splined portion 44 of the first shaft 40. The second impeller 52 is disposed between the front section 26 and the back section 30 and is mounted on the second shaft 42 for conjoint rotation with the second shaft 42. The second impeller 52 has a central, splined aperture 56, which receives and coacts with the splined portion 46 of the second shaft 42. The lobes 60 of the first impeller 50 and the lobes 62 of the second impeller 52 interengage in the product zone 36 for pumping a pumpable product (not shown) from the product inlet 14, through the product zone 36, into the product outlet 16. The first impeller 50 has a front seal face 64 and a back seal face 66. The second impeller 52 has a front seal face 68 and a back seal face 70. The front seal faces 64, 68, and the back seal faces 66, 70, are oriented radially. Each of the front and back seal faces of the respective impellers 50, 52, is coated (at least where such face is to coact with the seal face of one of the rigid seals to be next described) with a wear-resistant material, such as a ceramic material, which is ground to a smooth finish.

Furthermore, the pump 10 comprises four similar, rigid, non-rotating, annular seals 80. Each seal 80 is made from a sealing material in common use in rotary pumps, such as carbon (which is preferred) or silicon carbide. Each seal 80 has a stepped configuration so as to define plural faces including a seal face 82 facing in an axial direction, an offset face 84 facing in the same direction, and an opposite face 86, as well as an annular recess 88 at the face 86, as shown.

Each seal 80 is disposed around and in radially spaced relation to one of the shafts 40, 42, and is biased so that the seal face 82 of such seal 80 is pressed slidably against one of the wear resistant material-coated seal faces of the impellers 50, 52. Thus, the seal face 82 of one such seal 80 is pressed slidably against the front seal face 64 of the first impeller 50, and the seal face 82 of another such seal 80 is pressed slidably against the back seal face 66 of the first impeller 50. Also, the seal face 82 of another such seal 80 is pressed slidably against the front seal face 68 of the second impeller 52, and the seal face 82 of the remaining seal 80 is pressed slidably against the back seal face 70 of the second impeller 52.

Each seal 80 is biased by an elastomeric member 90, which is molded integrally to such seal 80, i.e., which is molded in a mold (not shown) containing such seal 80 in a known manner, so as to be permanently affixed to such seal 80. The elastomeric member 90 has a relatively thick, tubular portion 92 and a relatively thin, flanged portion 94. The flanged portion 94 extends radially from the tubular portion 92, at one end of the tubular portion 92. The flanged portion 94 has an integral, annular rib 96, which extends axially, and a cylindrical, outer surface 98. Each elastomeric member 90 is mounted to the housing structure 12 by a seal retainer 100, which has a tubular body 102 and an integral, radial flange 104. The housing structure 12 has a mounting portion 106, which includes a mounting flange 108 extending radially and having an annular groove 110, and which defines an annular recess 112 where the mounting flange 10 extends radially.

As associated with each seal 80, the flanged portion 94 of the elastomeric member 90 is disposed in the annular recess 112 with the annular rib 96 disposed in the annular groove 110 so as to improve the seal of the elastomeric member 90. The radial flange 104 of the seal retainer 100 is disposed against the housing structure 12, so as to retain the flanged portion 94 in the annular recess 112, and is secured to the housing structure 12 by bolts 114. The flanged portion 94 of the elastomeric member 90 provides an effective seal between the radial flange 104 of the seal retainer 100 and the mounting flange 108 of the housing structure 12. The annular rib 96 fitting into the annular groove 110 provides an additional seal therebetween. The tubular body 102 of the seal retainer 100 extends partly into the annular recess 88 of such seal 80 so as to provide alignment and radial support for such seal 80. The tubular portion 92 of the elastomeric member 90 is engaged with such seal 80, at the face 86 of such seal 80, and is compressed axially between the radial flange 104 of the seal retainer 100 and such seal 80 so as to press the seal face 82 of such seal 80 slidably against one of the wear resistant material-coated faces of the associated impeller. The tubular portion 92 of the elastomeric member 90 engages an outer surface 116 of the tubular body 102 of the seal retainer 100, along the tubular portion 92, and is supported by the tubular body 102 against being deflected in a radially inward direction by fluid pressure in the product zone. Fluid pressure in the annular chamber surrounding such seal 80 acts on the cylindrical surface 98 of the elastomeric member 90 and is transferred by the elastomeric member 90 to such seal 80.

The outer surface 116 of the tubular body 102 of the seal retainer 100, where the tubular body 102 engages the tubular portion 92 of the elastomeric member 90, may be advantageously coated with a friction-reducing material, such as PTFE, which is preferred. Such material facilitates relative shifting movements between the tubular portion 92 of the elastomeric member 90 and the tubular body 102 of the seal retainer 100, upon axial movement of the associated shaft and the associated impeller relative to the housing structure The seals 80 and the elastomeric members 90 isolate the shafts 40, 42, and the splined connections between the shafts 40, 42, and the impellers 50, 52, from the product zone 36. Because the seals 80 and the elastomeric members 90 do not create any tight crevices, they can be easily cleaned, by cleaning solution flow directed through the annular chambers surrounding the seals 80. Thus, the pump 10 can be effectively cleaned without disassembly, i.e., cleaned in place.

The housing structure 12 and the impellers 50, 52, define an annular chamber surrounding each seal 80 and surrounding a part of the tubular portion 92 of the elastomeric member 90 biasing such seal 80, at the cylindrical, outer surface 98 of the elastomeric member 90. An annular chamber 120, which is bounded partly by the front section 26 and partly by the front seal face 64 of the first impeller 50, surrounds the seal 80 pressed slidably against such face 64. An annular chamber 122, which is bounded partly by the front section 26 and partly by the front seal face 68 of the second impeller 52, surrounds the seal 80 pressed slidably against such face 68. An annular chamber 124, which is bounded partly by the back section 30 and partly by the back seal face 66 of the first impeller 50, surround the seal 80 pressed slidably against such face 66. An annular chamber 126, which is bounded partly by the back section 30 and partly by the back seal face 70 of the second impeller 52, surrounds the seal 80 pressed slidably against such face 68.

As shown in FIG. 5, the housing structure 12 defines a relatively short, inlet-side passageway communicating with the product inlet 14 via an inlet-side portion **36*a* of the product zone 36 near the product inlet 14 and with the annular chamber surrounding each seal and a relatively long, outlet-side passageway communicating with the annular chamber surrounding each seal and with the product outlet 16 via an outlet-side portion 36*b* of the product zone 36 near the product outlet 16. These passageways are defined by whichever of the front and back sections of the housing structure 12 is nearer such seal. As representative examples, an inlet-side passageway 134 communicating with the annular chamber 124, an inlet-side passageway 136 communicating with annular chamber 126, an outlet-side passageway 138 communicating with the annular chamber 122, and an outlet-side passageway 140 communicating with the annular chamber 126, as defined respectively by the back section 30, are shown in FIG. 5. Also, the inlet-side passageways 134, 136, are shown in FIGS. 6 and 7. Similar inlet-side and outlet-side passageways (not shown) are defined by the front section 26**.

The housing structure 12 defines a socket associated with each seal 80. The socket extends through the front section 26 or through the back section 30, whichever is nearer such seal, into the inlet-side portion 36*a* of the product zone 36. The socket communicates with the inlet-side passageway associated with such seal 80. As a first representative example, a socket 142 extending through the back section 30, into the same portion 36*a* of the product zone 36, and communicating with the inlet-side passageway 134 and with the annular chamber 124 is shown in FIGS. 5, 6, and 7. As a second representative example, a socket 144 extending through the back section 30, into the same portion 36*a* of the product zone 36, and communicating with the inlet-side passageway 136 communicating with the annular chamber 126 is shown in FIGS. 5, 6, and 7.

The pump 10 comprises, for each socket noted above, a main plug and an auxiliary plug. The main plug is adapted to be tightly fitted into such socket, which thus is sealed by an O-ring seal carried by the main plug, so as to close such socket and the inlet-side passageway with which such socket communicates. The auxiliary plug is adapted to be tightly fitted into such socket, which thus is sealed by an O-ring seal carried by the auxiliary plug, so as to close such socket but leave open the inlet-side passageway with which such socket communicates. As representative examples, a main plug 150 for the socket 142 and a main plug 152 for the socket 144 are shown in FIG. 7, and an auxiliary plug 154 for the socket 142 and an auxiliary plug 156 for the socket 144 are shown in FIGS. 3, 6, and 7. The main plugs (not shown) for the other sockets are similar to the main plugs 150, 152, function similarly, and are secured similarly. The auxiliary plugs (not shown) for the other sockets are similar to the auxiliary plugs 154, 156, function similarly, and are secured similarly.

The main plug 150 for the socket 142 comprises a cap portion 160, which is shaped so as to bear against an outer margin 162 of the socket 142, and a relatively long, stem portion 164, which is shaped so as to fit into the socket 142, to close the socket 142, and to extend at its distal end into close proximity with the impeller surface 60 thereby to close the inlet-side passageway 134. The socket margin 162 is defined partly by the radial flange portion 104 of the associated one of the seal retainers 100 and partly by the housing section 30. The stem portion 164 has an annular groove 166, which retains an O-ring seal 168 adapted to be tightly seated on an annular shoulder 170 formed in the socket 142. The O-ring seal 168 enables the main plug 150 to be tightly fitted into the socket 142. The cap portion 160 has an integral, external strap 172, which is used in securing the main plug 150.

The main plug 152 for the socket 144 is similar to the main plug 150 and comprises a cap portion 174, which is shaped so as to bear against an outer margin 176 of the socket 144, and a relatively long, stem portion 178, which is shaped so as to fit into the socket 144 to close the socket 144, and to extend at its distal end into close proximity with the impeller surface 70, thereby to close the inlet-side passageway !36. The socket margin 176 is defined partly by the radial flange 104 of the associated one of the seal retainers 100 and partly by the housing section 30. The stem portion 178 has an annular groove 180 , which retains an O-ring seal 182 adapted to be tightly seated in an annular shoulder 184 formed in the socket 144. The O-ring seal 182 enables the main plug 152 to be tightly fitted into the socket 144. The cap portion 174 has an integral, external strap 186, which is used in securing the main plug 152.

A flat bar 190 has a first end 192 fitting under the integral strap 172 of the cap portion 160 of the main plug 150, a second end 194 fitting under the integral strap 186 of the cap portion 174 of the main plug 152, and an aperture 196 accommodating a bolt 198, which was a threaded shank 200 extending through the aperture 196 and which has a hex head 202. The threaded shank 200 is adapted to extend through the aperture 196 of the flat bar 190, into a threaded socket 204 in the back section 30 of the housing structure 12, so as to secure the main plug 150 in the socket 142 and the main plug 152 in the socket 144 via the flat bar 190.

The auxiliary plug 154 for the socket 142 comprises a cap portion 210, which is shaped so as to bear against the outer margin 162 of the socket 142, and a relatively short, stem portion 212, which is shaped so as to fit into the socket 142, to close the socket 142, but not to close the inlet-side passageway 134. The stem portion 212 has an annular groove 214, which retains an O-ring seal 216 adapted to be tightly seated on the annular shoulder 170 formed in the socket 142. The O-ring seal 216 enables the auxiliary plug 154 to be tightly fitted into the socket 142. The cap portion 210 has an integral, external strap 218, which is used in securing the auxiliary plug 154.

The auxiliary plug 156 for the socket 144 is similar to the auxiliary plug 154 and comprises a cap portion 220, which is shaped so as to bear against the outer margin 176 of the socket 144, and a relatively short, stem portion 222, which is shaped so as to fit into the socket 144, to close the socket 144, but not to close the inlet-side passageway 136. The stem portion 222 has an annular groove 224, which retains an O-ring seal 226 adapted to be tightly seated on the annular shoulder 184 formed in the socket 144. The O-ring seal 226 enables the auxiliary plug 156 to be tightly fitted into the socket 144. The cap portion 220 has an integral, external strap 228, which is used in securing the auxiliary plug 156.

The flat bar 190 and the bolt 198 are used also to secure the auxiliary plugs 154, 156. Thus, the first end 192 of the flat bar 190 fits under the integral strap 218, and the second end 194 thereof fits under the integral strap 228. Also, the threaded shank 200 of the bolt 198 extends through the aperture 196, into the threaded socket 204.

Each of the main plugs is interchangeable with one of the auxiliary plugs. The main plugs exemplified by the plugs 150, 152, adapt the pump 10 for pumping a pumpable product (not shown) by preventing product flow into the annular chambers surrounding the seals 80, to the low-pressure side of the pump 10, via the inlet-side passageways exemplified by the passageways 134, 136. High-pressure product from the outlet side of the pump 10 fills the annular chambers surrounding the seals 80, via the outlet-side passageways exemplified by the passageways 138, 140. It is tolerable and may be even desirable to have some product fill the annular chambers surrounding the seals, from the high-pressure side of the pump 10, via the outlet side passageways exemplified by the passageways 138, 140. Because the outlet-side passageways are open to the high pressure side of the pump 10, product pressure at the seals is higher than outside pressure. Thus, any leakage at the seals is outward leakage, which can be visually observed, and which averts product contamination. The auxiliary plugs exemplified by the plugs 154, 156, adapt the pump 10 for being cleaned Without disassembly, i.e., cleaned in place.

For cleaning the pump 10, the auxiliary plugs exemplified by the plugs 154, 156, are used, whereby the inlet-side passageways exemplified by the passageways 134, 136, are open, along with the outlet-side passageways exemplified by the passageways 138, 140. A cleaning solution (not shown) is caused to flow through the pump 10, preferably from the product inlet 14, through the passageways 134, 136, and the other outlet-side passageways, through the annular chambers surrounding the respective shaft-isolating seals 80, through the passageways 138, 140, and the other outlet-side passageways, into the product outlet 16. If the shafts 40, 42, and the impellers 50, 52, are rotated while the cleaning solution flows through the pump 10, the surfaces of the impellers 50, 52, are cleaned as such surfaces pass the passageways 138, 140, and the other outlet-side passageways.

As shown in FIG. 8, rather than the main and auxiliary plugs, a diaphragm valve 230 can be alternatively used to control fluid flow between the product inlet 14 and the annular chamber surrounding each seal 80. One such valve 230 is associated with each seal 80. The valve 230 is connected at an inlet branch 232, via an inlet conduit 234, so as to communicate with the product inlet 14. The valve 230 is connected at an outlet branch 236, via a conduit 238, so as to communicate with the annular space surrounding the associated seal 80. A flexible diaphragm 240 is arranged to be selectively moved toward and away from a valve seat 242, via a handwheel 244, in a known manner. Precise details of such diaphragm valves, which are used widely in food processing and other industries, can be readily supplied by those skilled in the art. Other valves (not shown) of known types may be alternatively substituted for such diaphragm valves.

As shown, the seals 80 are the only rotary seals between the housing structure 12 and the respective impellers 50, 52. Each seal 80 is statically loaded by initial compression of the tubular portion 92 of the elastomeric member 90 biasing such seal 80 between the radial flange 104 of the seal retainer 10? associated therewith and such seal 80.

Each seal 80 is hydraulically balanced. Thus, fluid pressure in the annular chamber surrounding such seal 80 is applied against the cylindrical, outer surface 98 of the tubular portion 92 of the elastomeric member 90 biasing such seal 80 so as to transfer fluid pressure to the faces 84, 86, of such seal 80. Fluid pressure on the face 84 and fluid pressure transferred by the tubular portion 92 of the elastomeric member 90 to an area on the face 86, namely a radially outer area opposite to the face 84, produce forces that cancel each other so as not to effect any net pressure on the seal face 82. Fluid pressure transferred thereby to the remaining area of the face 86, namely a radially inner area opposite to a radially outer area of the seal face 82, is transferred by such seal 80 to the seal face 82. The radially outer area of the seal face 82 constitutes approximately one-half of the total area of the seal face 82. Consequently, seal pressure between the seal face 82 and the impeller seal face engaged by the seal face 82 tends to be substantially uniform under varying product pressures.

Figure 9:
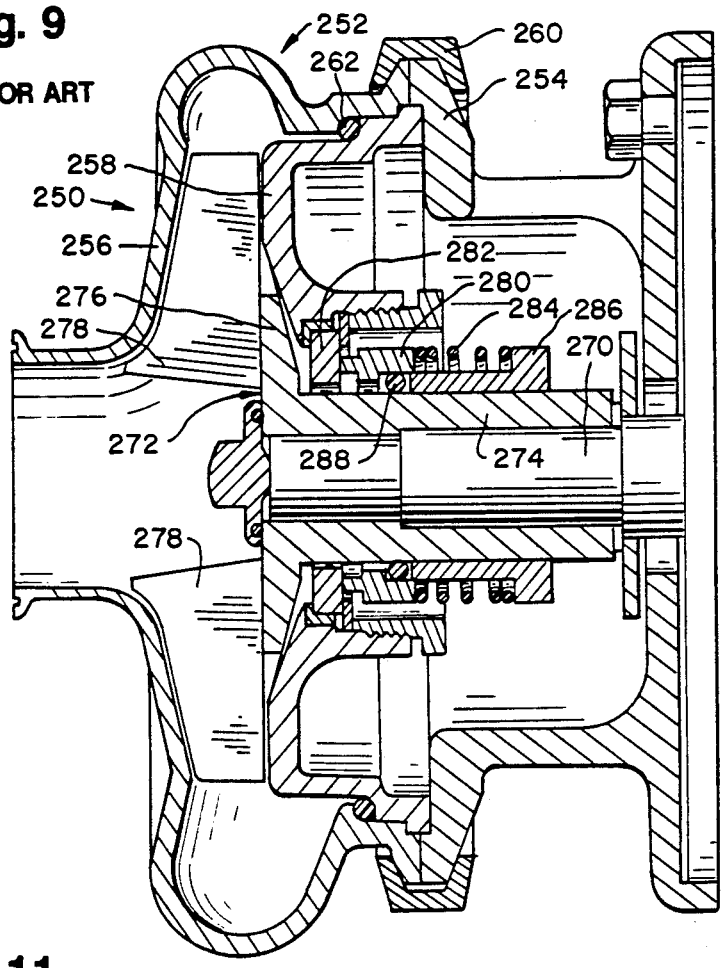
Fig. 9 PRIOR ART
FIG. 9 is a fragmentary view taken in cross-section to show a rotary, centrifugal pump exemplifying prior art.

As shown in FIG. 9, a rotary, centrifugal pump 250 of sanitary construction for pumping food products exemplifies prior art. The pump 250 is similar in some respects to a pump disclosed in Cantor et al. U.S. Pat. No. 4,538,959. An abbreviated description of the pump 250 follows. Further details of such a pump, as known heretofore, can be readily supplied by persons having ordinary skill in the art.

The pump 250 comprises a housing structure 252, which includes a bracket 254, a cover 256, an annular back plate 258, as assembled by a clamping ring 260 with an O-ring 262 disposed between the cover 256 and the back plate 258. The pump 250 comprises a shaft 270, which is journalled via bearings (not shown) and which is arranged to be rotatably driven by a motor (not shown) of the pump 250. The pump 250 comprises an impeller 272, which is mounted on the shaft 270 for conjoint rotation with the shaft 270. The impeller 272 has a sleeve portion 274 surrounding the shaft 270 and a flange portion 276. A plurality of similar vanes 278 are fixed to the flange portion 276 of the impeller 272.

A complex seal is provided between the housing structure 252 and the impeller 272. A rigid seal 280, such as a carbon seal, is disposed around the sleeve portion 274 of the impeller 272. The seal 280 is rotatable with the shaft 270 and with the impeller 272. A member 282 coacting with the seal 280 is mounted to the housing structure 252. A coiled spring 284, which is retained by a spring retainer 286, biases the rigid seal 280 against the member 282. The spring retainer 286 is mounted on the sleeve portion 274 of the impeller 272 so as to be conjointly rotatable therewith. An O-ring 288 is disposed between the seal 280 and the sleeve portion 274 of the impeller 272, within recesses defined by the seal 280, the spring retainer 286, and the sleeve portion 274. As shown, the O-ring 288 and associated recesses form a crevice that is difficult to clean, even under ideal conditions.

Figure 10:
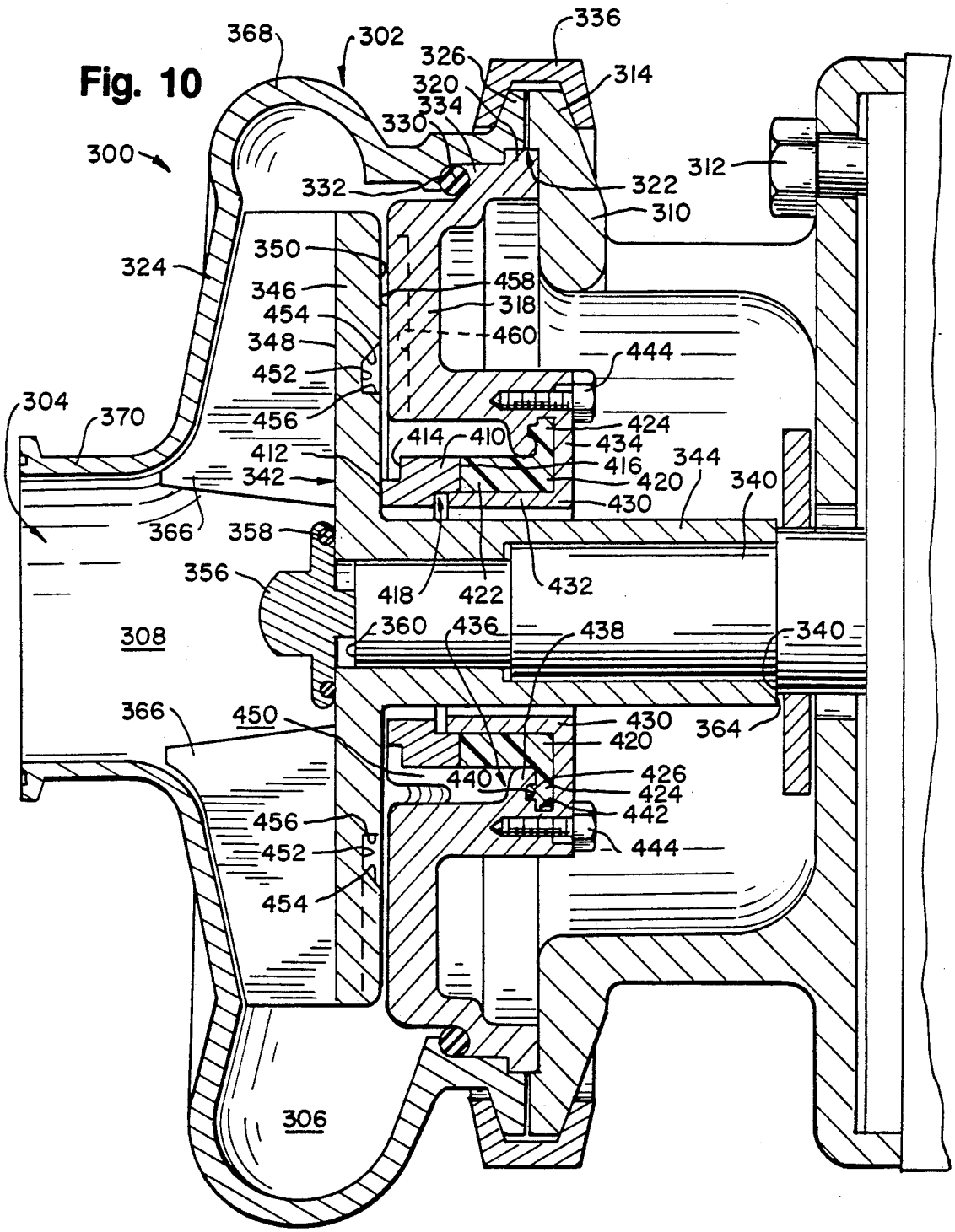
FIG. 10, on a larger scale compared to FIG. 9, is a fragmentary view taken in cross-section to show a rotary, centrifugal pump constituting an alternate embodiment of this invention.

As shown in FIG. 10, a rotary, centrifugal pump 300 constitutes an alternate embodiment of this invention. A complex seal like the complex seal of the pump 250 is not used. Rather, a single seal like the seals 80 of the pump 10 is used, which enables the pump 300 to be effectively cleaned in place.

The pump 300 comprises a housing structure 302 having a product inlet 304 and a product outlet 306. The housing structure 302 defines a product zone 308 and defines an axis. The product inlet 304 opens into the product zone 308 at the axis. The product outlet 306 opens from the product zone 308 and is spaced radially from the axis.

The housing structure 302 comprises a bracket 310, which is secured by bolts 312 (one shown) to other components of the pump 300. The bracket 310 has an annular flange 314. The housing structure 302 comprises an annular back plate 318 having an outer rib 320, which is received by an annular recess 322 formed in the annular flange 314, and a cover 324 having an annular flange 326 with an annular recess 328 receiving the outer rib 320. An O-ring 330 is disposed between an annular shoulder 332 formed on the cover 324 and an annular shoulder 334 formed on the annular back plate 318. A clamping ring 336 used to secure the annular flanges 314, 326, to each other.

A shaft 340 is extended axially into the housing structure 302 via enlarged apertures in the bracket 310 and in the annular back plate 318. The shaft 340 is journalled via bearings (not shown) and is arranged to be rotatably driven by a motor (not shown) of the pump 300.

An impeller 342 is mounted on the shaft 340 for conjoint rotation with the shaft 340. The impeller 342 comprises a sleeve portion 344, which surrounds the shaft 340, and a flange portion 346, which has a front face 348 facing the product inlet 304 and a back face 350. The back face 350 serves as a seal face. A retainer 356 carrying an O-ring 358 in a groove therein is used to mount the impeller 342 on one end 360 of the shaft 340 with the O-ring 358 disposed between the retainer 356 the flange portion 346. One end 362 of the sleeve portion 344 and a shoulder 364 formed on the shaft 340 interengage so as to prevent axial movement of the impeller 342 along the shaft 340, away from the retainer 356. A plurality of similar vanes 366, which are fixed to the flange portion 346 of the impeller 342, extend from the front face 348.

The cover 324 has an annular portion 368, which is disposed to receive a product (not shown) being pumped, as the product is driven centrifugally by the vanes 366 of the impeller 342, when the shaft 340 and the impeller 342 are rotated conjointly. The product inlet 304 is defined by a tubular portion 370 of the cover 324. The product outlet 306 opens from the annular portion 368.

The pump 300 has a rigid, non-rotating, annular seal 410, which is similar to each seal 80 of the pump 10, with a seal face 412 facing in an axial direction, an offset face 414 facing in the same direction, and an opposite face 416, as well as an annular recess 418 at the face 416, as shown. The seal 410 is disposed around and in radially spaced relation to the sleeve portion 344 of the impeller 342. The seal 410 is biased so that its seal face 412 is pressed slidably against the back face 350 serving as a seal face of the impeller 342.

The seal 410 is biased by an elastomeric member 420, which is molded integrally to the seal 410 and which is similar to each elastomeric member 90 of the pump 10, with a tubular portion 422 and a flanged portion 424 extending radially from the tubular portion 422, at one end of the tubular portion 422. The flanged portion 424 has an integral, annular rib 426, which extends axially. The elastomeric member 420 is mounted to the housing structure 302, via the annular back plate 318, by a seal retainer 430. The seal retainer 430, which is similar to each seal retainer 100 of the pump 10, has a tubular body 432 and an integral, radial flange 434. The annular back plate 318 has a mounting portion 436, which is analogous to each mounting portion 106 of the housing structure 12 of the pump 10, with a mounting flange 438 extending radially and having an annular groove 440 and with an annular recess 442 where the mounting flange 438 extends.

The flanged portion 424 of the elastomeric member 420 is disposed in the annular recess 442 with the annular rib 426 disposed in the annular groove 440. The radial flange 434 of the seal retainer 430 is disposed against the annular back plate 318, so as to retain the flanged portion 424 in the annular recess 442, and is secured to the annular back plate 318 by bolts 444. The tubular body 432 of the seal retainer 430 extends partly into the annular recess 418 of the seal 410 so as to provide alignment and radial support for the seal 410. The tubular portion 422 of the elastomeric member 420 is engaged with the seal 410, at the face 416 of the seal 410, and is compressed axially between the radial flange 434 of the seal retainer 430 and the seal 410 so as to press the seal face 412 of the seal 410 slidably against back face 350 serving as the seal face of the impeller 342.

The seal 410 and the elastomeric member 420 isolate the sleeve portion 344 of the impeller 342 and the shaft 340 from any product being pumped by the pump 300. Because the seal 410 and the elastomeric member 420 do not create any tight crevices, they can be easily cleaned, whereby the pump 300 can be effectively cleaned without disassembly, i.e., cleaned in place.

Figure 11:
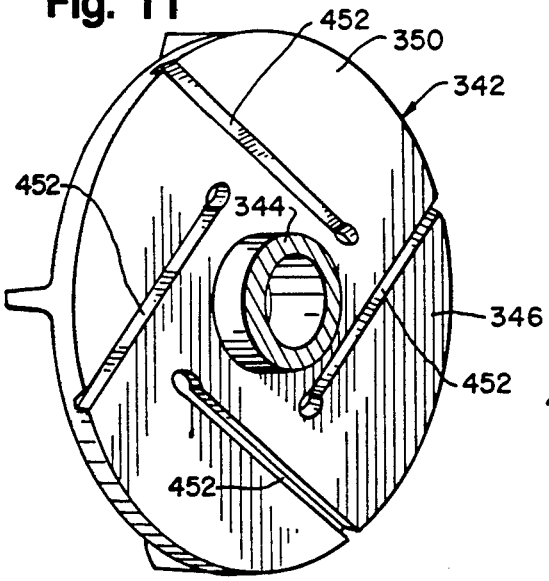
FIG. 11, on a smaller scale compared to FIG. 10, is a perspective view showing fluid passageways provided in an impeller of the pump of FIG. 10.
Figure 12:
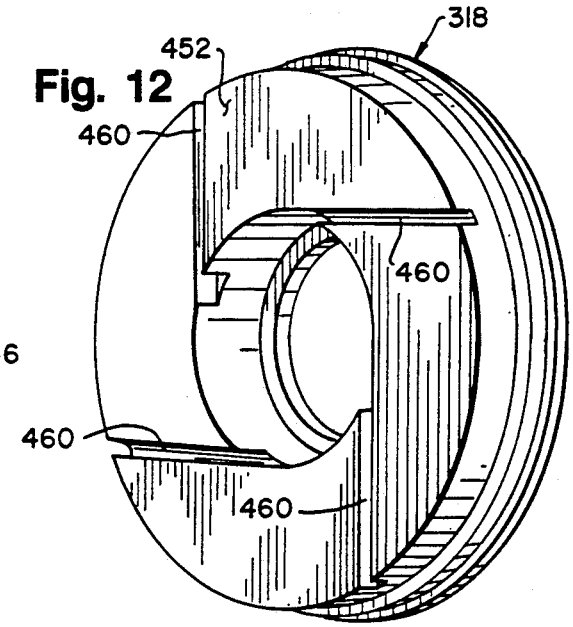
FIG. 12, on a similar scale, is a perspective view showing fluid passageways provided in an annular back plate of the pump of FIG. 10.

The annular back plate 318 of the housing structure 302 defines an annular chamber 450 surrounding the annular seal 410 and surrounding a part of the tubular portion 422 of the elastomeric member 420. The back face 350 of the impeller 342 defines four grooves 452, which communicate between the annular chamber 450 and the product zone, via the annular portion 368 of the cover 324. As shown in FIG. 11, each groove 452 extends outwardly toward the annular portion 368, in a direction tangent to an imaginary circle on the back face 350, the imaginary circle being in coaxial relation to the shaft 340. As shown in FIGS. 10 and 11, each groove 452 is trapezoidal in cross-section, with a leading edge 454 inclined to the back face 350 and a trailing edge 456 normal to the back face 350. The annular back plate 318 has a front face 458, which is spaced closely from the back face 350 of the impeller 342. The front face 458 defines four grooves 460, which communicate between the annular chamber 450 and the product zone 308, via the annular portion 368. Each groove 460 extends outwardly to the annular portion 368, in a direction tangent to an imaginary circle on the front face 458, the imaginary circle being in coaxial relation to the shaft 340.

For cleaning the pump 300, a cleaning solution (not shown) is caused to flow through the pump 300, in the direction of product flow, while the pump 300 is running. If the shaft 340 and the impeller 342 are rotated in a clockwise direction when viewed from the rear (from the right in FIG. 10) while the cleaning solution flows through the pump 300, the cleaning solution flows across the back face 350 of the impeller 342 and across the front face 458 of the annular back plate 318 so as to clean both of these faces. Moreover, a pumping action is produced, whereby the cleaning solution tends to flow inwardly into the annular chamber 450 surrounding the seal 410, via the grooves 460, from the high-pressure region at the outer ends of such grooves 460. The pumping action produces opposite flow of the cleaning solution via the grooves 452. Such flow creates turbulence in such chamber 450 so as to facilitate cleaning the seal 410 and such chamber 450.

As shown, the seal 410 is the only rotary seal between the housing structure 302 and the impeller 342. The seal 410 is statically loaded by initial compression of the tubular portion 422 of the elastomeric member 420 between the radial flange 434 of the seal retainer 430 and the seal 410. The seal 410 is hydraulically balanced, as each seal 80 of the pump 10 is hydraulically balanced, whereby seal pressures tend to be substantially uniform with varying product pressures.

Various modifications may be made in either of the illustrated embodiments without departing from the scope and spirit of this invention.

I claim:

1. A rotary apparatus comprising a housing structure defining a product zone exposed to fluid pressure when the apparatus operates, a rotary structure including a shaft extending at least partly through the housing structure and defining an axis, the rotary structure being rotatable about the axis, the rotary structure having a seal face, and means for isolating at least a portion of the shaft from fluid pressure in the product zone, the isolating means comprising a rigid, non-rotatable, annular seal supported by the housing structure, around the shaft, the seal having a seal face pressed against the seal face of the rotary means, and an elastomeric member having a portion mounted fixedly to the housing structure and a portion compressed so as to press the seal face of the seal against the seal face of the rotary structure, the elastomeric member having a tubular portion and a flanged portion, which extends radially from the tubular portion, the isolating means comprising a seal retainer having a tubular body and an integral, radial flange, the tubular body extending at least partly through the seal so as to provide radial support for the seal, the housing structure having a mounting portion, to which the radial flange of the seal retainer is secured in such manner that the flanged portion of the elastomeric member is retained between the radial flange of the seal retainer and the mounting portion, that the tubular portion of the elastomeric member engages an outer surface of the tubular body of the seal retainer, along the tubular portion of the elastomeric member, and is supported by the tubular body against being deflected in a radially inward direction by fluid pressure in the product zone, and that the elastomeric member is compressed axially between the seal and the radial flange.

2. The apparatus of claim 1 wherein the elastomeric member is molded integrally to the seal.

3. The apparatus of claim 1 wherein the outer surface engaging the tubular portion of the elastomeric member is coated with a friction-reducing material, which facilitates relative shifting movements between the tubular portion of the elastomeric member and the tubular body, along the coated surface, upon axial movement of the seal face of the rotary means relative to the housing structure.

4. A rotary, lobar, positive-displacement pump comprising (a) a housing structure having a product inlet, a product outlet in opposed in relation to the product inlet, an opposed pair of first apertures, and an opposed pair of second apertures and defining a product zone, (b) a first shaft defining an axis and extending through the product zone via the first apertures, a second shaft defining an axis and extending through the product zone via the second apertures, the respective shafts being parallel to each other and being arranged to be simultaneously but oppositely rotatable about their respective axes, (c) a first impeller mounted on the first shaft for conjoint rotation with the first shaft, the first impeller having plural lobes and having a front seal face and a back seal face, a second impeller mounted on the second shaft for conjoint rotation with the second shaft, the second impeller having plural lobes and having a front seal face and a back seal face, the impellers being arranged so that the lobes of the first impeller and the lobes of the second impeller interengage in the product zone for pumping a pumpable product from the product inlet, through the product zone, into the product outlet, and (d) means for isolating the respective shafts from any product being pumped, the isolating means comprising four non-rotating, annular, rigid seals and four elastomeric members, each seal having a seal face, each elastomeric member biasing a respective one of the seals so as to press the seal face thereof slidably against the seal face of a respective one of the impellers, the seals being pressed respectively against the front seal face of the first impeller, against the front seal face of the second impeller, against the back seal face of the first impeller, and against the back seal face of the second impeller, each elastomeric member having a tubular portion and a flanged portion, which extends radially from the tubular portion, the isolating means comprising four seal retainers, each seal retainer having a tubular body and an integral, radial flange, the tubular body extending at least partly through a respective one of the seals so as to provide radial support therefor, the housing structure having a mounting portion, to which the radial flange is secured in such manner that the flanged portion of a respective one of the elastomeric members is retained between the radial flange and the mounting portion, that the tubular portion of the same one of the elastomeric members engages an outer surface of the tubular body, along the tubular portion thereof, and is supported by the tubular body against being deflected in a radially inward direction by fluid pressure in the produce zone, and that the same one of the elastomeric members is compressed axially between the seal having the tubular body extending at least partly therethrough and the radial flange of such seal retainer.

5. The pump of claim 4 wherein the housing structure and the impellers define an annular chamber surrounding each seal and surrounding a portion of the elastomeric member biasing such seal, wherein the housing structure defines an inlet-side passageway communicating with the product inlet via a portion of the product zone near the product inlet via a portion of annular chamber surrounding each seal and an outlet-side passageway communicating with the annular chamber surrounding each seal and with the product outlet via a portion of the product zone near the product outlet, and wherein the pump comprises means for closing the respective inlet-side passageways so as to adapt the pump for being used to pump a pumpable product and for opening the respective inlet-side passageways so as to adapt the pump for being cleaned without disassembly.

6. The pump of claim 4 wherein the housing structure and the impeller define an annular chamber surrounding each seal and surrounding the elastomeric member biasing such seal and wherein the pump comprises means including a separate valve associated with each seal for controlling fluid flow between the product inlet and the annular chamber surrounding such seal.

7. The pump of claim 4 wherein the seals biased by the elastomeric members constitute the only rotary seals between the housing structure and the respective impellers.

8. The pump of claim 7 wherein each of the seals biased by the elastomeric members has a stepped configuration with the seal face thereof facing in an axial direction, with an offset face thereof facing in the same direction, and with an opposite face engaging a respective one of the elastomeric members, the offset face being exposed to fluid pressure in the product zone such that fluid pressure on the offset face thereof and fluid pressure transferred by the same one of the elastomeric members to an area on the opposite face thereof, produce forces that cancel each other so as not to effect any net pressure on the seal face thereof, the seal face being offset such that the seal face area opposite to the elastomeric member is approximately one-half of the total seal face area.

9. A rotary, lobar, positive-displacement pump comprising (a) a housing structure having a product inlet, a product outlet in opposed relation to the product inlet, an opposed pair of first apertures, and an opposed pair of second apertures and defining a product zone, (b) a first shaft defining an axis and extending through the product zone via the first apertures, a second shaft defining an axis and extending through the product zone via the second apertures, the respective shafts being parallel to each other and being arranged to be simultaneously but oppositely rotatable about the respective axes, (c) a first impeller mounted on the first shaft for conjoint rotation with the first shaft, the first impeller having plural lobes and having a front seal face and a back seal face, a second impeller mounted on the second shaft for conjoint rotation with the second shaft, the second impeller having plural lobes and having a front seal face and a back seal face, the impellers being arranged so that the lobes of the first impeller and the lobes of the second impeller interengage in the product zone for pumping a pumpable product from the product inlet, through the product zone, into the product outlet, and (d) means for isolating the respective shafts from any product being pumped, the isolating means comprising four non-rotating, annular, rigid seals and four elastomeric members, each seal having a seal face, each elastomeric member biasing a respective one of the seals so as to press the seal face thereof slidably against the seal face of a respective one of the impellers, the seals being pressed respectively against the front seal face of the first impeller, against the front seal face of the second impeller, against the back seal face of the first impeller, and against the back seal face of the second impeller, wherein the housing structure and the impellers define an annular chamber surrounding each seal and surrounding a portion of the elastomeric member biasing such seal, wherein the housing structure defines an inlet-side passageway communicating with the product inlet via a portion of the product zone near the product inlet and with the annular chamber surrounding each seal and an outlet-side passageway communicating with annular chamber surrounding each seal and with the product outlet via a portion of the product zone near the product outlet, and wherein the pump comprises means for closing the respective inlet-side passageways so as to adapt the pump for being used to pump a pumpable product and for opening the respective inlet-side passageways so as to adapt the pump for being cleaned without disassembly, and wherein the housing structure defines a socket associated with each seal, the socket communicating with the product inlet and with the inlet-side passageway communicating with the annular chamber surrounding such seal, and wherein the means for closing the respective inlet-side passageways so as to adapt the pump for being used to pump a pumpable product and for opening the respective inlet-side passageways so as to adapt the pump for being cleaned without disassembly compresses a main plug for each socket, the main plug being adapted to be tightly fitted into such socket so as to close such socket and the inlet-side passageway with which such socket communicates, and an auxiliary plug for each socket, the auxiliary plug being adapted to be tightly fitted into such socket so as to close such socket but not the inlet-side passageway with which such socket communicates, the main plugs adapting the pump for being used to pump a pumpable material and the auxiliary plugs adapting the pump for being cleaned without disassembly.

10. A rotary, centrifugal pump comprising (a) housing structure having a product inlet and a product outlet and defining an product zone, the housing structure defining an axis, the product inlet opening axially into the product zone at the axis and the product outlet being spaced radially from the axis, (b) a shaft defining an axis coincident with the axis defined by the product zone and having an end extending axially into the product zone, the shaft being arranged to be rotatably driven, (c) an impeller mounted to the shaft for conjoint rotation of the impeller with the shaft, the impeller comprising a sleeve portion surrounding the shaft end and a flange portion having a front surface facing the product zone and a back surface defining a seal face, the impeller comprising generally radial vanes extending from the front surface, and (d) means comprising an annular seal supported by the housing structure and an elastomeric member mounted to the housing structure for isolating at least a portion of the shaft from fluid pressure in the product zone, the seal being disposed around and in radially spaced relation to the shaft, the seal being pressed slidably against the seal face so as to permit conjoint rotation of the shaft and the impeller relative to the housing structure and the seal, and so as to isolate the sleeve portion from any product being pumped by the pump, the elastomeric member biasing the seal against the axially facing surface, the elastomeric member having a tubular portion and a flanged portion, which extends radially from the tubular portion, the isolating means comprising a seal retainer having a tubular body and an integral, radial flange, the tubular body extending at least partly through the seal so as to provide radial support for the seal, the housing structure having a mounting portion, to which the radial flange of the seal retainer is secured in such manner that the flanged portion of the elastomeric member is retained between the radial flange of the seal retainer and the mounting portion, that the tubular portion of the elastomeric member engages an outer surface of the tubular body of the seal retainer, along the tubular portion of the elastomeric member, and is supported by the tubular body against being deflected in a radially inward direction by fluid pressure in the product zone, and that elastomeric member is compressed axially between the seal and the radial flange.

11. The pump of claim 10 wherein the housing structure has a surface close to the back surface and wherein the housing structure defines passageways between the back surface and the housing structure surface close thereto, the passageways facilitating liquid flow between other regions of the product zone and region between the seal and the housing structure.

12. The pump of claim 11 wherein the back surface and the housing structure surface close to the back surface respectively define passageways between the back face and the housing structure surface close thereto, the passageways facilitating liquid flow between other regions of the product zone and region between the seal and the housing structure.

13. The pump of claim 10 wherein the seal constitutes the only rotary seal between the housing structure and the impeller.

14. The pump of claim 13 wherein the seal is hydraulically balanced.

* * * * *

UNITED STATES PATENT AND TRADEMARK OFFICE

CERTIFICATE OF CORRECTION

PATENT NO. :5,096,396

DATED :March 17, 1992

INVENTOR(S) : Elmer S. Welch

It is certified that error appears in the above-identified patent and that said Letters Patent is hereby corrected as shown below:

On the Title page, item [56], References Cited, U.S. Patent Documents, "9/1969" should be --7/1969--.

Column 4, line 48, "an" should be --a--;

Column 6, line 45, "4" should be --40--;

Column 8, line 26, --12.-- should be inserted after "structure".

Column 10, line 2, "!36" should be --136--.

Column 11, line 50, "10?" should be --100--.

Column 13, line 14, --and-- should be inserted after "356".

Column 15, line 48, (claim 4) second occurrence of "in" should be deleted.

Column 16, line 43, "via a portion of" should be --and with the --.

UNITED STATES PATENT AND TRADEMARK OFFICE

CERTIFICATE OF CORRECTION

PATENT NO. : 5,096,396

DATED : March 17, 1992

INVENTOR(S) : Elmer S. Welch

It is certified that error appears in the above-indentified patent and that said Letters Patent is hereby corrected as shown below:

Col. 18, line 22, "an" should be --a--.

Signed and Sealed this

Twenty-ninth Day of June, 1993

Michael K. Kirk

*Attest:*

MICHAEL K. KIRK

*Attesting Officer*

*Acting Commissioner of Patents and Trademarks*